US011852430B1

(12) United States Patent
Halverson et al.

(10) Patent No.: US 11,852,430 B1
(45) Date of Patent: Dec. 26, 2023

(54) FIREARM SAFETY DEVICE AND RACK INCORPORATING SAFETY DEVICE

(71) Applicant: DQD Mounting Systems, LLC, Kuna, ID (US)

(72) Inventors: Tate Halverson, Nampa, ID (US); Clifford Turner, Nampa, ID (US)

(73) Assignee: DQD Mounting Systems, LLC, Kuna, ID (US)

( * ) Notice: Subject to any disclaimer, the term of this patent is extended or adjusted under 35 U.S.C. 154(b) by 0 days.

(21) Appl. No.: 17/807,350

(22) Filed: Jun. 16, 2022

(51) Int. Cl.
*F41A 17/46* (2006.01)
*A47B 81/00* (2006.01)
*F41A 23/18* (2006.01)

(52) U.S. Cl.
CPC ..... *F41A 17/46* (2013.01); *A47B 81/005* (2013.01); *F41A 23/18* (2013.01)

(58) Field of Classification Search
CPC ..... F41A 17/02; F41A 17/04; F41A 17/46; F41A 23/18
See application file for complete search history.

(56) References Cited

U.S. PATENT DOCUMENTS 920,682 A * 5/1909 Stephan ..... F41A 17/46 42/70.06
989,817 A * 4/1911 Siegel ..... F41A 17/46 42/70.06
1,470,029 A * 10/1923 Pedersen ..... F41A 3/26 42/16
2,379,946 A * 7/1945 Baker ..... F41A 17/46 42/70.06
2,635,379 A 4/1953 Baker et al.
2,635,380 A * 4/1953 Baker ..... F41A 17/22 42/70.06
2,978,826 A * 4/1961 Ivy ..... F41A 17/22 42/70.06

(Continued)

FOREIGN PATENT DOCUMENTS

CA 2281754 11/2008
EP 1160499 A1 5/2001
WO 2011023511 A1 3/2011

*Primary Examiner* — Derrick R Morgan
(74) *Attorney, Agent, or Firm* — Scott Swanson; Shaver & Swanson, LLP

(57) ABSTRACT

A firearm safety device having a bolt for insertion through a trigger guard toward the lower receiver of the firearm. The bolt is inserted through the trigger guard so as to be positioned behind the trigger, in an axis generally perpendicular to the direction of pull of the trigger to prevent the trigger from be depressed and thus firing the weapon. The bolt extends from a base, which can be static in the form of a fixed bolt, or dynamic with the bolt configured for mechanized or electromechanical insertion through the trigger guard, such as by a lever operation, solenoid operation, or other operation. In one embodiment the safety device has a bolt affixed to a base, with the base configured to attach to the trigger guard. This embodiment provides a freely mobile transportable safety device. The safety device can be used with or integral with a firearm support mount, such as a gun rack. In this preferred with the bolt and/or base providing support beneath the firearm, while a front mount is provided to support the front of the lower receiver, or alternatively the stock or barrel of the firearm.

17 Claims, 16 Drawing Sheets

(56) References Cited

U.S. PATENT DOCUMENTS 2,979,845 A * 4/1961 Christiansen, Jr. ..... F41A 17/06 42/106
3,085,462 A 4/1963 Myers
3,368,297 A * 2/1968 Lentz ..... F41A 17/44 42/70.07
3,777,384 A * 12/1973 Ruger ..... F41A 17/74 42/70.08
4,182,453 A 1/1980 Worswick
4,198,026 A * 4/1980 Capolupo ..... F41A 23/18 42/70.07
4,825,576 A * 5/1989 Troncoso ..... F41A 17/54 42/70.07
4,852,286 A * 8/1989 Troncoso ..... F41A 17/54 42/70.07
5,012,605 A * 5/1991 Nishioka ..... F41A 17/54 42/70.07
5,024,017 A * 6/1991 Nishioka ..... F41A 17/54 42/70.07
5,048,212 A * 9/1991 Mossberg ..... F41A 17/46 42/70.11
5,337,100 A 8/1994 Oxford
5,367,811 A * 11/1994 Sansom ..... F41A 17/54 42/70.07
5,433,028 A * 7/1995 Novak ..... F41A 17/06 42/70.11
5,546,690 A * 8/1996 Ciluffo ..... F41A 17/066 42/70.11
5,579,923 A * 12/1996 Hemmerlein ..... F41A 23/18 42/70.11
5,621,996 A * 4/1997 Mowl, Jr. ..... F41A 17/063 42/70.07
5,636,464 A * 6/1997 Ciluffo ..... F41A 17/066 42/70.11
5,649,383 A * 7/1997 Wesp ..... F41A 21/484 42/63
5,724,760 A * 3/1998 Langner ..... F41A 17/54 42/70.07
5,918,402 A 7/1999 Wienraub
5,927,578 A * 7/1999 Kay ..... F41A 17/46 42/70.07
6,032,396 A * 3/2000 Shapiro ..... F41A 19/16 42/70.11
6,134,822 A * 10/2000 Murgel ..... F41A 17/54 42/70.07
6,142,313 A * 11/2000 Young ..... F41A 17/02 42/70.11
6,301,816 B1 * 10/2001 Saltz ..... F41A 17/54 42/70.07
6,330,815 B1 12/2001 Duncan
6,405,468 B1 * 6/2002 Gilgenbach ..... F41A 17/46 42/70.01
6,415,539 B1 * 7/2002 Fuchs ..... F41A 17/46 42/70.07
6,467,211 B1 * 10/2002 Kielland ..... F41A 17/54 42/70.07
6,550,175 B2 * 4/2003 Parker ..... F41A 17/54 42/70.07
6,637,904 B2 10/2003 Hernandez
7,036,258 B1 * 5/2006 Lee ..... F41A 17/46 42/70.07
7,077,582 B2 7/2006 Johnson
7,568,302 B1 * 8/2009 Bubits ..... F41A 17/56 42/70.11
8,104,213 B2 1/2012 Keng et al.
8,266,835 B2 9/2012 Pintar et al.
8,398,315 B2 3/2013 Johnson
8,628,258 B2 1/2014 Vogt
8,653,974 B2 * 2/2014 Crook ..... G08B 25/10 340/568.1
9,328,998 B2 5/2016 Volfson
9,482,482 B1 * 11/2016 Sanders ..... A47B 81/005
9,958,225 B1 * 5/2018 Richetti ..... F41A 17/46
10,048,032 B1 * 8/2018 Lazar ..... F41A 17/44
10,139,184 B1 * 11/2018 Pintar ..... F41A 23/18
10,161,706 B2 12/2018 Roberts et al.
10,310,249 B1 6/2019 Bentley
10,578,390 B2 3/2020 Pintar
11,112,202 B2 * 9/2021 Myers ..... F41A 17/54
2002/0029507 A1 * 3/2002 Saltz ..... F41A 17/54 42/70.07
2002/0116856 A1 * 8/2002 Troyer ..... F41A 17/04 42/70.11
2002/0157296 A1 * 10/2002 Vivian ..... F41A 17/066 42/70.11
2002/0178634 A1 * 12/2002 Weinraub ..... F41A 17/54 42/70.07
2003/0218108 A1 11/2003 Werner
2004/0129038 A1 7/2004 Vercoe
2004/0144009 A1 * 7/2004 Lee ..... F41A 17/46 42/70.06
2006/0112605 A1 * 6/2006 Sopko ..... F41A 17/54 42/70.11
2009/0158634 A1 * 6/2009 Bubits ..... F41A 17/22 42/70.06
2010/0107465 A1 * 5/2010 Pintar ..... F41A 17/02 42/70.07
2010/0218670 A1 9/2010 Keng
2011/0126444 A1 6/2011 Keng et al.
2017/0122010 A1 * 5/2017 McCanna ..... F41A 23/18
2017/0363380 A1 * 12/2017 Alicea, Jr. ..... F41A 17/46
2019/0178599 A1 * 6/2019 Pintar ..... F41A 17/54
2020/0050086 A1 2/2020 Thompson et al.
2022/0307785 A1 * 9/2022 Ytsma ..... F41A 23/18
2023/0145076 A1 * 5/2023 Halverson ..... F16B 2/16 403/326
2023/0250678 A1 * 8/2023 Kesler ..... F41A 17/30 211/8

* cited by examiner

FIREARM SAFETY DEVICE AND RACK INCORPORATING SAFETY DEVICE

FIELD OF THE INVENTION

The presently disclosed technology relates to a safety device for reducing accidental discharge of a firearm. More particularly, the present invention is a safety device that provides a rod or post behind the trigger of a firearm, and can be used as a safety device and integrated into a firearm rack.

BACKGROUND OF THE INVENTION

An AR-15 or similar firearm generally includes a barrel attached to a lower receiver. The lower receiver is attached to an upper receiver to form an action through which an ammunition is received and fired. An assembled AR-15 utilizes a lower receiver having a trigger extending typically in the opposite direction from the upper receiver. The trigger is depressed by a user to cause the firing operation of the action, causing the firearm to propel a projectile through the barrel attached to the lower receiver. A trigger guard in combination with the lower receiver provide a circular, oval, or other shaped enclosure to provide a safety mechanism against accidental depression of the trigger. A stock and grip typically extend rearward from the lower receiver. The AR-lower receiver can be commercially available with an integrated trigger guard, or alternatively with a trigger guard that is wholly or partially removable. A variety of safety mechanisms exist to prevent the accidental or mistaken firing of the firearm. Some of these involve mechanical inhibition of the operating of the firearm action.

For example, FIG. 1 of US Patent Publication No. 2014/0237878 illustrates an exploded view of a firearm, showing a lower receiver 10 having an integral trigger guard. The trigger of the lower receiver is typically protected by a trigger guard, being most often a rounded flange that prohibits the trigger from being bumped or otherwise grasped from below. The trigger guard facilitates intentional operation of the firearm by a user, having to insert the user's fingers through the trigger guard to the front of the trigger. The trigger is then depressed toward the rear of the trigger guard to cause the operation of a firing pin within the lower receiver to operate on a primer of an ammunition round within the action assembly period.

Firearms such as AR-15s are often positioned in racks for storage, such as in a home or alternatively, in a rack for transportation in a vehicle. For example, law enforcement agencies often position elongated firearms in a rack. The rack must facilitate easy access by the law enforcement officer while preventing accidental discharge or discharge by an unauthorized person accessing the firearm. Thus, it is important to facilitate storage while preventing unauthorized access to the action of the firearm.

SUMMARY

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is an improved firearm safety mechanism for use with a firearm. The device can be utilized as a standalone safety unit or integrated in a rack or similar support system. The device has a bolt that inserts through an opening in the lower section of the trigger guard of a firearm. The bolt is positioned to extend behind the trigger in the depression space behind the trigger of the firearm. The bolt prevents the trigger from being pulled or depressed, thus preventing the firing mechanism, or action, of the firearm from firing. The trigger extends generally perpendicular to the receiver, such as the lower receiver of an AR-15 style firearm, and the trigger is generally depressed by a force that is parallel to the length of the firearm. The bolt is positioned generally parallel to the vertical axis of the trigger, preventing the pulling force from depressing the trigger.

When the bolt is integrated into the a rack, the body of the safety device is called a receiver support and is integrated into the rack. The body is configured for supporting a receiver of a long firearm, typically by supporting the weight of the trigger guard. The bolt defines a bolt longitudinal axis. The bolt is configured for positioning through an opening in a trigger guard of a firearm. The trigger guard of the firearm is beneath the trigger, being opposite the action of the firearm. The trigger guard extend horizontally to and generally parallel to a direction of pull of the trigger. The bolt is configured to extend through the opening of the trigger guard into a depression space behind the trigger to prevent depression of the trigger. The bolt can be configured for active or passive insertion through the trigger guard. In passive insertion the bolt is fixed and the firearm is positioned on to the rack with the bolt extending through the trigger guard. In an active embodiment, the firearm is positioned on the rack with an actuator provided to extend and retract the bolt through the trigger guard and into the depression space.

The actuator is configured to move the bolt from a closed position in which the bolt is in the depression space behind the trigger to an open position in which the bolt is removed from the opening in the trigger guard. The actuator can be a lever, with the lever being configured to actuate insertion of the bolt into and out of the opening in the trigger guard. In a preferred embodiment the lever is a paddle that provides a cover over the exposed trigger in the locked or closed position.

The front support can a post configured for insertion into an opening in the front of the receiver of the firearm. Typically the post will extend so as to be parallel or on the length of the rifle. The post can utilize an active retention mechanism, such as that referenced in the applicant's co-pending application Ser. No. 17/523,733. In an example of an active retention mechanism one or more posts utilizes a series of ball bearings positioned along a circumference of the post. The ball bearings are biased outward from the circumference of the post. The retention mechanism comprises a post retention actuator configured to release the biasing on the ball bearings, thus releasing the retention mechanism. This actuator can be a button, sliding lever, or other actuator.

Alternatively the rack can utilize a lever that has a nesting space in the body of the rack. In one such embodiment disclosed the lever slides the bolt upward into the closed position, and the lever is rotated into the nesting space. This function serves to reduce accidental operation of the lever. The lever can further utilize a locking mechanism, such as a lock core, which is well known in lock art.

Preferably the rack has a mechanism for preventing rotation and/or lifting of the stock of the firearm when the firearm is positioned on the rack, thus preventing the firearm from being rotated off of or pulled off of the rack and bolt. For example, the body of the rack can utilize a variety of mechanisms for interaction with specific receiver embodiments, such as a pin extending from the body of the rack in a direction generally perpendicular to the bolt. In this embodiment the pin is configured for insertion into a grip of the lower receiver. Such a grip is commonly referred to as a pistol grip. This prevents the stock and pistol grip from rotating horizontally relative to the bolt, or from being lifted upward off of the bolt. Alternatively a hook, clamp, or other device can be used to prevent rotation and/or lifting of the stock when positioned with the bolt in the depression space behind the trigger.

The receiver support and the front support can be spaced apart and attached directly to a substrate of a rack. A substrate can be any surface to which a firearm rack is installed, such as the frame of a vehicle, an interior wall of a vehicle, a wall of a house or building, or anywhere a firearm could be stored. Alternatively the receiver support and front support can be attached by a rack body, which is configured for attachment to a substrate.

The trigger guard can be a part of a lower receiver of a modular firearm, such as an AR-15 style firearm. These firearms typically utilize interchangeable components. The lower receiver can be produced with an integral trigger guard having an opening, or alternatively as part of a removable/replaceable trigger guard. Typically removable trigger guards are retained on the lower receiver by a pair of pins at opposing ends of the trigger guard. The trigger guard body extends between the first end and the second end, and positioned between the first end and the second end is the opening configured for the bolt of the rack and/or safety device. The opening is positioned such that when the trigger guard is attached to the lower received, the opening is positioned to allow the bolt to extend generally perpendicular to the lengthwise axis of the firearm, immediately behind or posterior to the trigger. The bolt extends parallel to a vertical axis of the trigger. The vertical axis extends perpendicular to the longitudinal axis of the firearm.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature

BRIEF DESCRIPTION OF DRAWINGS

FIG. 8.1 is an isometric front view of the embodiment of FIG. 6 in a closed position.

FIG. 13.1 is a front view of the embodiment of FIG. 10 with the bolt and lever in the closed position.

FIG. 22.1 is a perspective view of the embodiment of the safety device of FIG. 22 removed from the lower receiver.

DETAILED DESCRIPTION OF THE INVENTION

Figure 1:
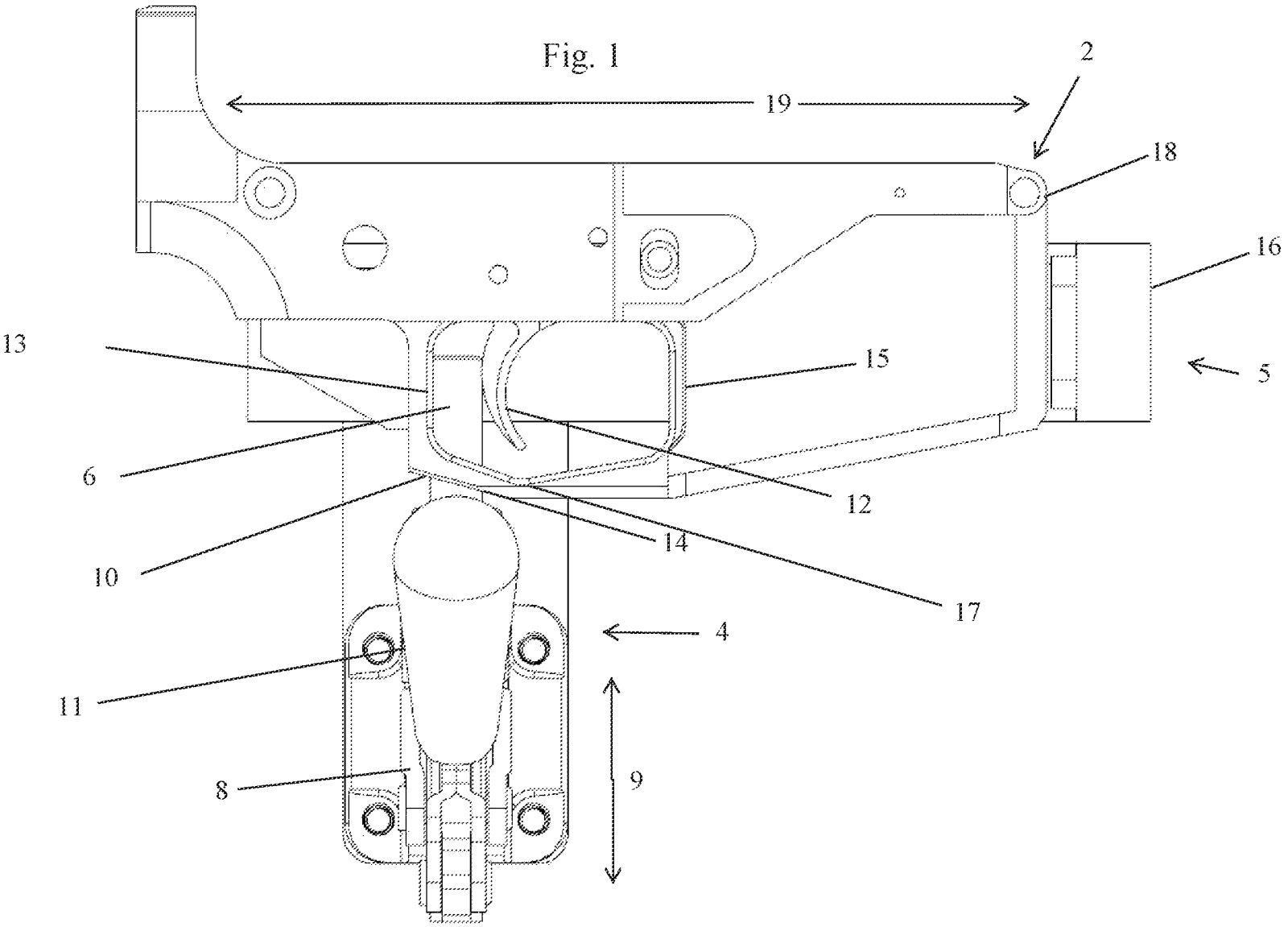
FIG. 1 is an isometric side view of an embodiment of a firearm mount with an integral safety device with a lower unit of a firearm installed thereon.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

FIG. 1 illustrates a lower receiver 2 of a firearm. The lower receiver is shown detached from the barrel and stock of the firearm. The lower receiver 2 is attached to a mount and lock having a bolt 6 configured to prevent depression of the trigger 17. The bolt 6 is retractable in and out of the trigger guard 10 via an opening (not shown). A lever 8 is provided to actuate the insertion and removal of the bolt 6 through the opening 10 of the trigger guard. The trigger guard 10 extends from the rear portion 13 to a front portion 15. Typically, a trigger guard is formed in a round or rectangular shape to prevent accidental depression of the trigger. The actuating lever 8 has a handle 11 that a user grasps to move the lever up and down to insert the bolt 6 into and out of the trigger guard. The bolt is configured and formed to occupy the space between the trigger 12 and the rear trigger guard 13, when the trigger 12 is in a resting position. The opening in the trigger guard 15 is formed at a bottom section 17 of the trigger guard. This allows the bolt to be inserted in a direction generally perpendicular to a longitudinal axis of the firearm 19. The mounting system utilizes a mount 5 for the front 18 of the lower receiver. A variety of forward mounting options can be utilized. The depicted embodiment utilizes a mounting system disclosed in the applicants co-pending application Ser. No. 17/523,733 utilizing two posts that are selectively operable to engage two receiver voids in the mount 16. Alternatively, a passive system can be utilized such that the front of the receiver has a void or opening and the mounting block 16 utilizes a post or similar.

Figure 2:
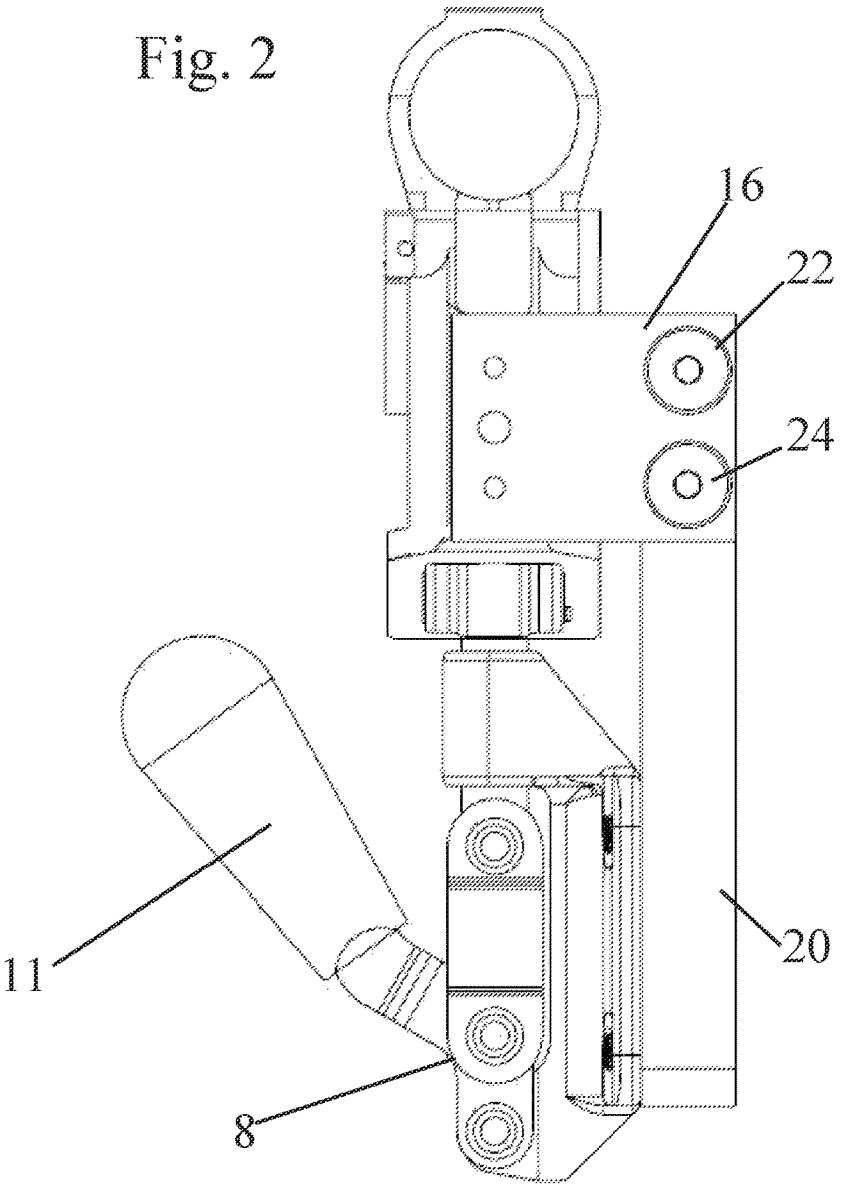
FIG. 2 is a front isometric view of an embodiment of the firearm mount of the mount and lower of FIG. 1.
Figure 3:
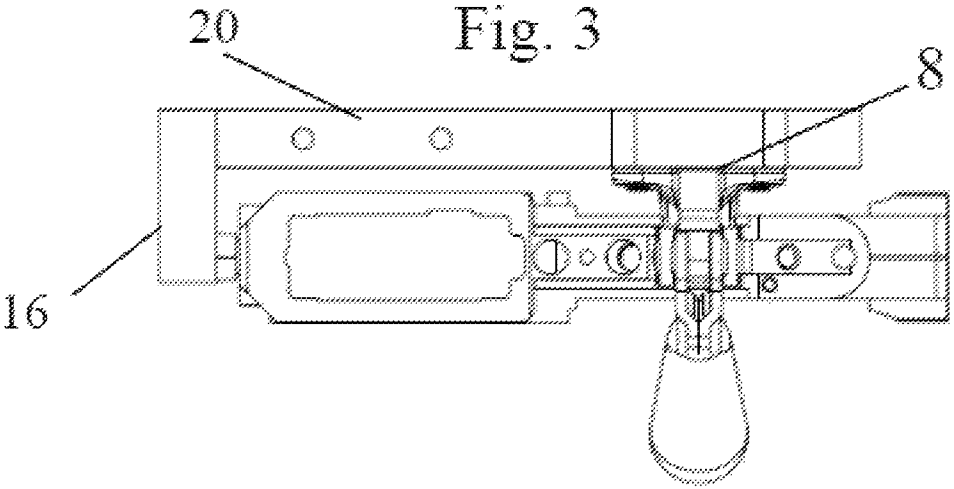
FIG. 3 is a bottom isometric view of an embodiment of the firearm mount of the mount and lower of FIG. 1.

FIG. 2 illustrates a front isometric view of the lower receiver and mounting system of FIG. 1. Preferably, the mounting system is provided as a single unit that is configured to be attached to, for example, a wall or other mounting systems. In the depicted embodiment, the lever 8 is separated from the front mounting system by a body 20. The front block 16 is attached to the body by bolts or screws 22, 24. The front block provides a secondary mounting system to provide a mount to support the front portion of the firearm. FIG. 3 illustrates a bottom isometric view of the mounting system, illustrating the body 20 extending between the front block 16 and the lever section 8.

Figure 4:
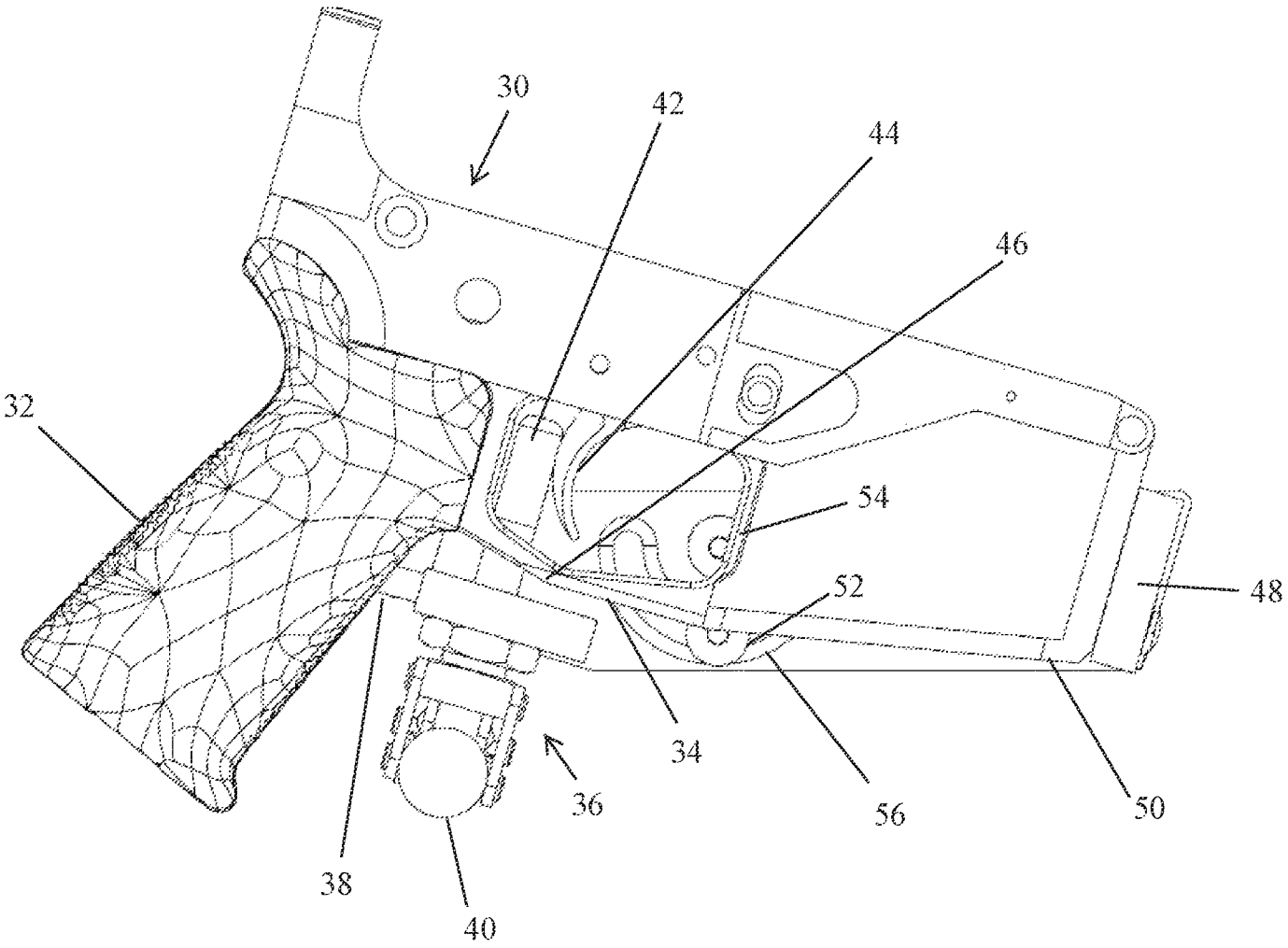
FIG. 4 is an alternate embodiment of a firearm mount with an integral safety device with a lower receiver having a pistol grip attached thereto and a pin extending from the safety device into the pistol grip to support the pistol grip.

FIG. 4 illustrates an alternate embodiment of a mounting system utilizing a trigger lock bolt 42 securing a lower unit 30 having a pistol grip 32. This is commonly referred to as a pistol lower. The lever system 36 has a bolt 42 that extends through an opening of the trigger guard 46. The lever further utilizes a passive retention bolt 38. When the firearm having a lower 30 and pistol grip 32 having an opening 39 (see FIG. 5) is positioned on the mount, the opening in the trigger guard is positioned onto the passive post 38 of the mount, thus positioning the lower in the correct position. The front of the lower 50 is configured for mounting to the front mounting block 48 either via a passive mount system such as bolt and opening, or similar mounting system. The mounting of the front of the lower 2 the block 48 in combination with the post 38 of the lever provides correct positioning to orient the lower portion of the trigger guard 34 having an opening through which the trigger lock bolt 42 is positioned by the lever.

Figure 5:
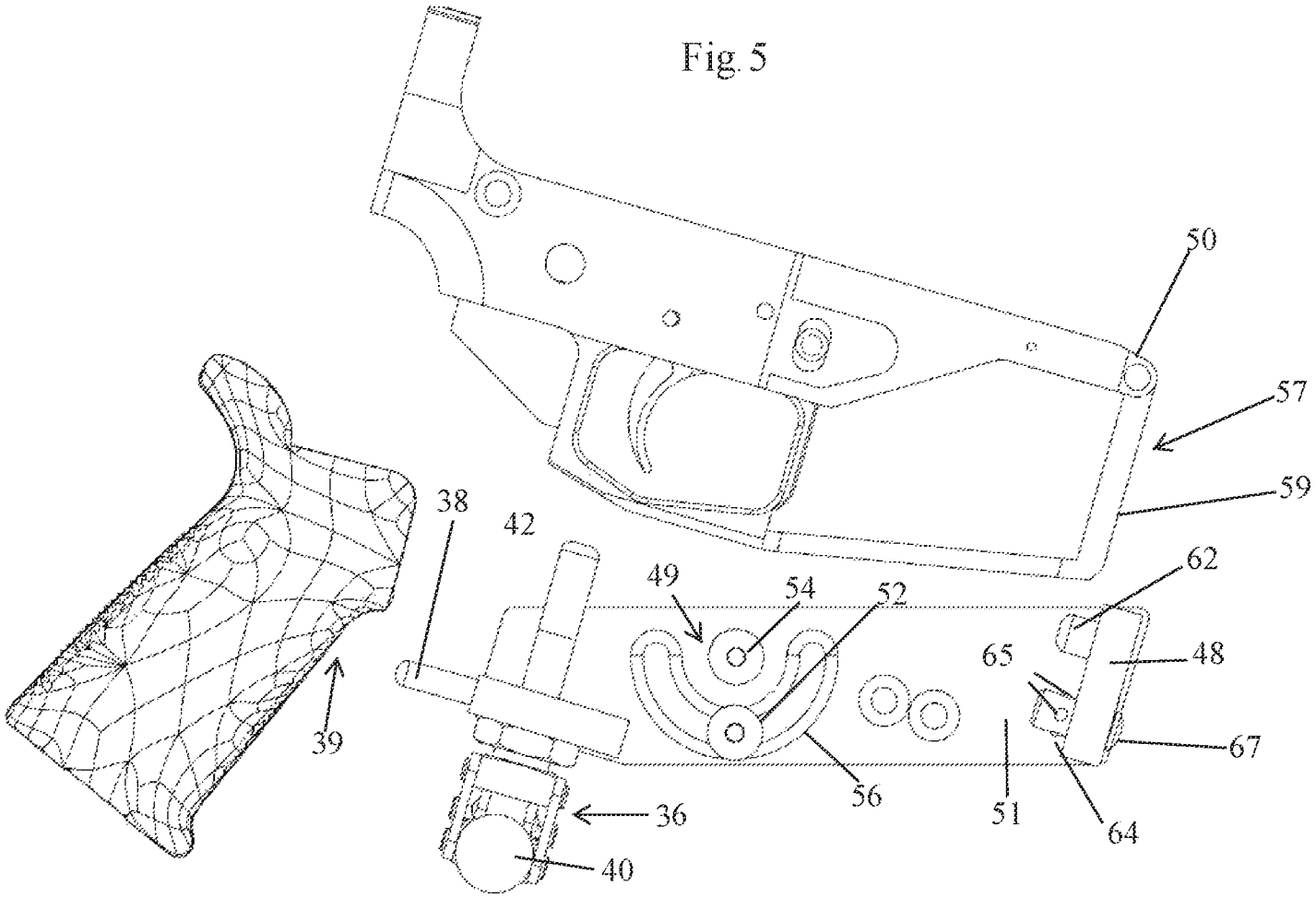
FIG. 5 is a partially exploded isometric view of the embodiments of FIG. 4.

FIG. 5 illustrates an exploded isometric view of the embodiment of FIG. 4. The lever 36 and trigger lock bolt 42 are shown in the extended position. The handle 40 can be retracted or depressed to withdraw the bolt into the lever assembly 36. The body 51 of the mounting system extends between the lever assembly 36 and the front block 48. In the depicted embodiment, the body has an adjustable mounting system 49 to mount the body to a wall, rack, or other mounting surface. In the depicted embodiment, two screws 42, 44 connect the body to the mounting surface. The lower bolt 52 can be loosened, allowing the body to rotate around the upper bolt 54. The front mounting block 48 is illustrated with two posts that correspond to two openings 57, 59 in the front 50 of the lower receiver. The two posts 62, 64 are illustrated with the upper post 62 being passive and the lower post 64 being an active mounting post. The lower post 64 has a series of ball bearings 65 positioned around the circumference the post. The ball bearings are oriented with a release mechanism 67. Depression of the release mechanism holding the ball bearing outwards causes the ball bearings to be released, allowing the post to be withdrawn from the opening 57. The opening 57 has a channel within the opening that is positioned and configured for the ball bearings to be placed into the channel to hold the front of the lower unit and the opening on the post 64.

Figure 6:
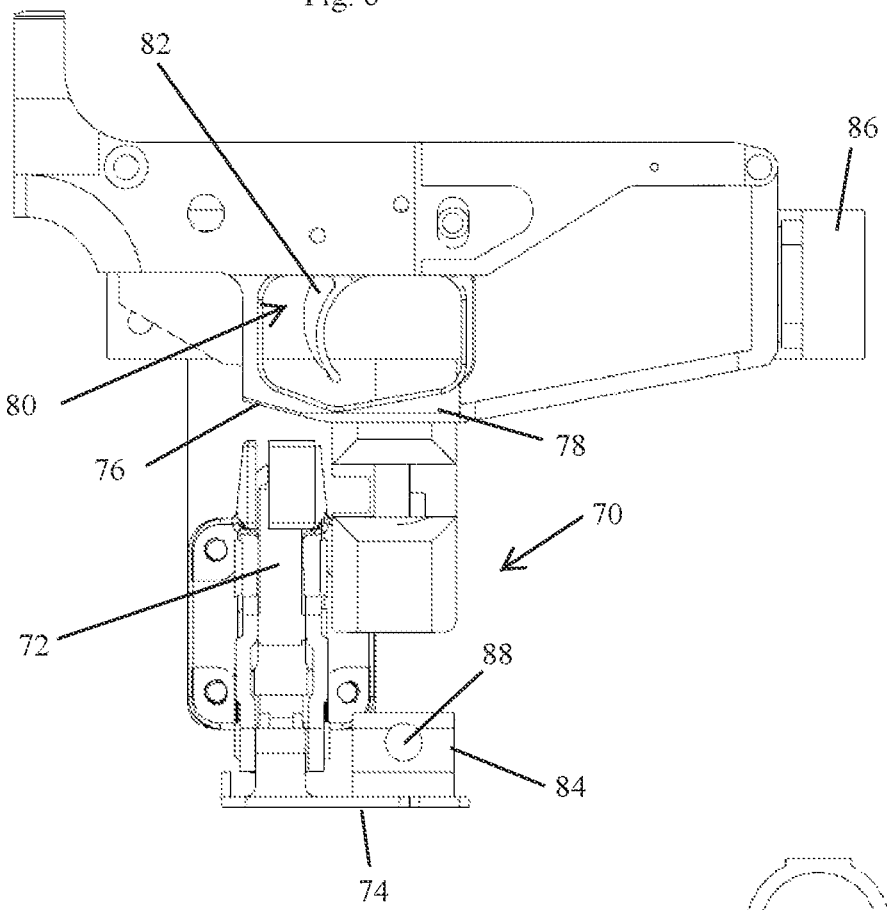
FIG. 6 is an isometric view of an alternate embodiment of a firearm mount with an integral safety device in an open position having a lever forming a paddle to prevent access to the trigger of a firearm in a closed position.
Figure 8:
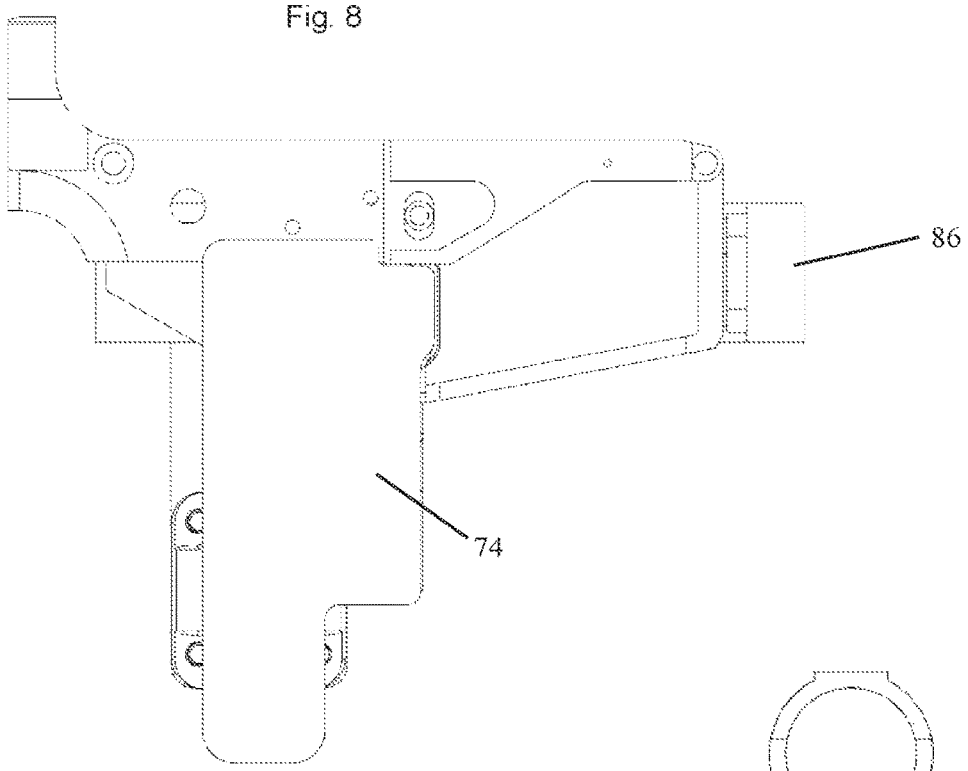
FIG. 8 is an isometric view of the embodiment of FIG. 6 in a closed position.
Figure 8:
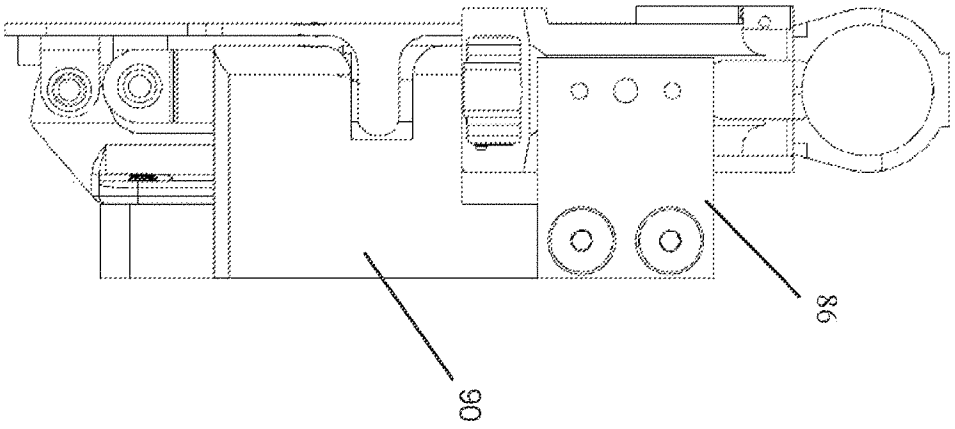

FIG. 6 illustrates an alternate embodiment of a security mount 70 having a moveable bolt 72. The bolt is actuated by a lever 74 forming a paddle that serves to move the bolt vertically in the depicted embodiment. The bolt inserts through an opening in the lower section 76 of the trigger guard 78. The bolt inserts into the space 80 behind the trigger 82. The lever 74 further serves to cover the opening of the trigger guard thus further preventing access to the trigger when in the closed position as shown in FIG. 8.

Figure 7:
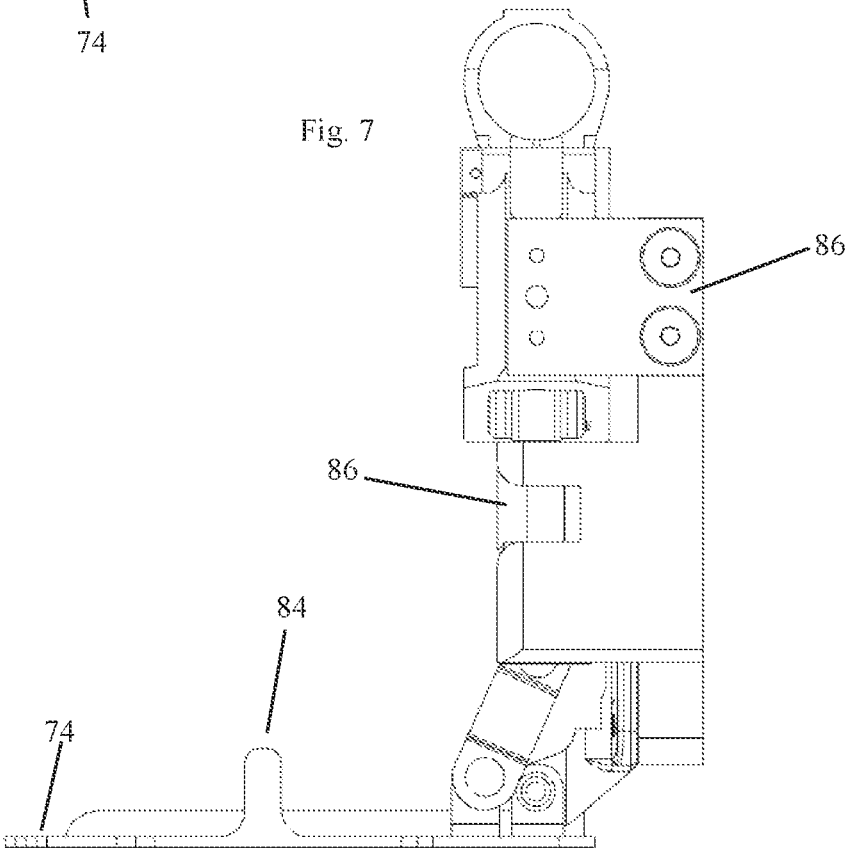
FIG. 7 is an isometric front view of the embodiment of FIG. 6 in an open position.
Figure 9:
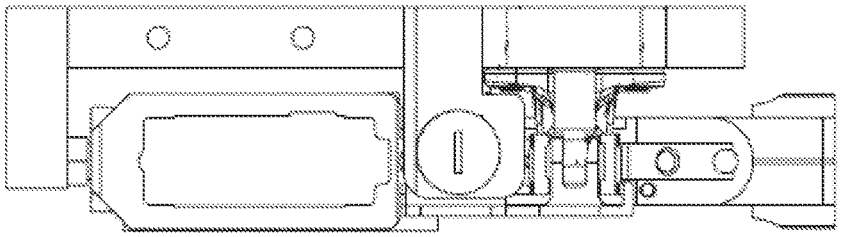
FIG. 9 is an isometric bottom view of the embodiment of FIG. 6 in a closed position.

FIG. 7 illustrates an isometric side view of the safety device of FIG. 6 having the lever 74 extended downward in an open position. The bolt 72 is shown retracted out of the trigger guard in this position. The secondary or front mount 86 is similar to that depicted in the previous embodiment. The lever utilizes a tab 84 that extends into the opening 86 in the locked position. An opening 88 in the tab provides a continuous opening that allows for a keyed lock core 87 to be inserted into the opening. A typical keyed lock can be used to lock the lever in the closed position with the mount, as illustrated in FIG. 8. The keyed lock will secure the lever in the closed or guarded positioned illustrated in FIG. 8. FIG. 8.1 illustrates a side view of the tab inserted for the mechanical lock inserted into the body of the locking mechanism 90. FIG. 9 illustrates a bottom view of the closed lever of FIGS. 6-8.1 illustrates the keyed lock core 87 securing the paddle in position on the safety device.

Figure 10:
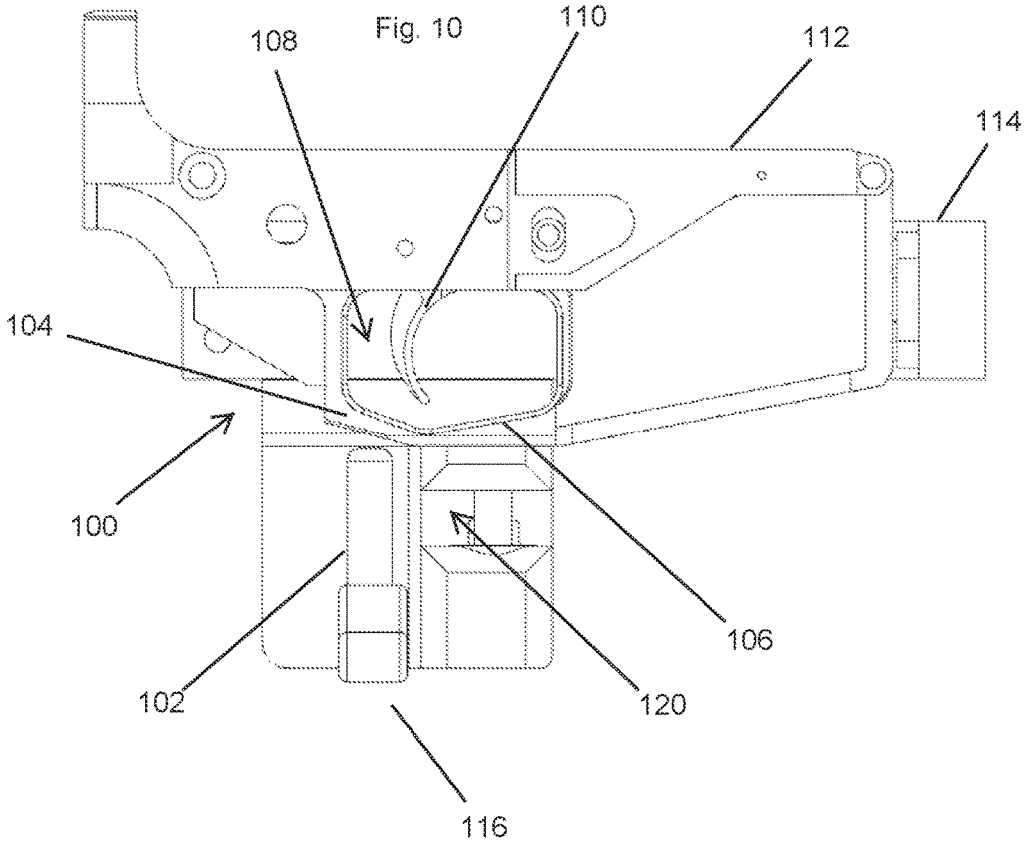
FIG. 10 is an isometric view of an alternate embodiment of a safety device and rack utilizing in an open position utilizing a spring and ramp mechanism to slide the lever and bold into the closed position.
Figure 11:
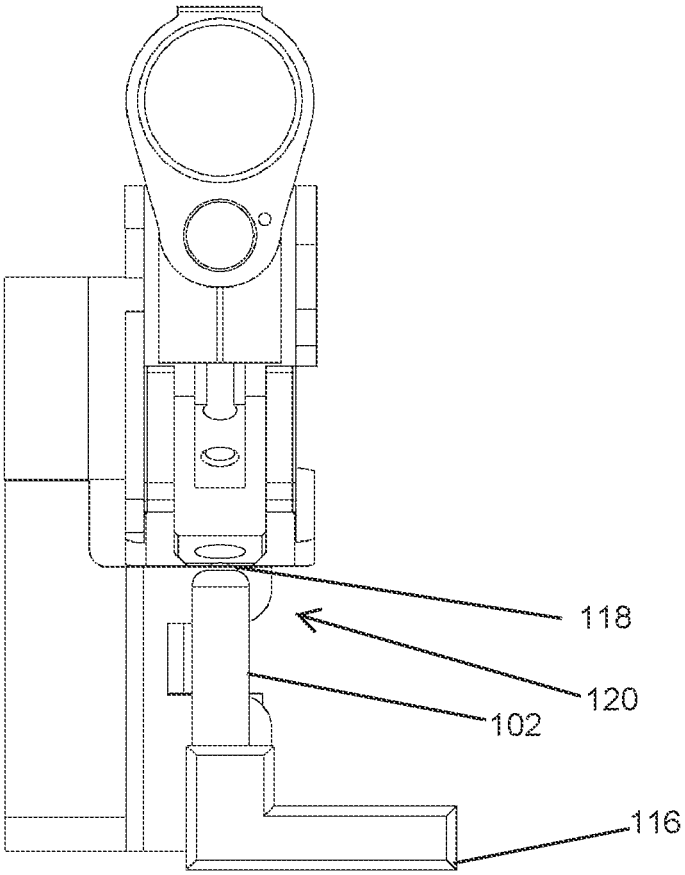
FIG. 11 is a back view of the embodiment of FIG. 10.

FIGS. 10-13.1 illustrate a further alternate embodiment of the storage rack having a lock out post and using a spring and ramp mechanism to cause sliding of the bolt into the depression space behind the trigger, and subsequent rotation of the bolt and lever to position the lever into a closed position in which the lever can be secured or locked in the closed position. The FIG. 10 illustrates the post 102 in a retracted position, the post is configured to be inserted into and through the lower end 104 of the trigger guard 106. The post in the locked positioned in the space 108 behind the trigger 110 behind of the lower 112 depicted. The forward mount 114 is shown to support the lower unit below where the barrel would be positioned in an assembled firearm. FIG. 11 illustrates a side view of a mount of FIG. 10 having the lever 116 in an extended or open position. The lever is moved vertically into the opening 118 in the trigger guard. The bolt 102 and lever are then slid upward, and the lever and bolt are rotated into the space 120 of the mount to obtain the closed or locked position.

Figure 12:
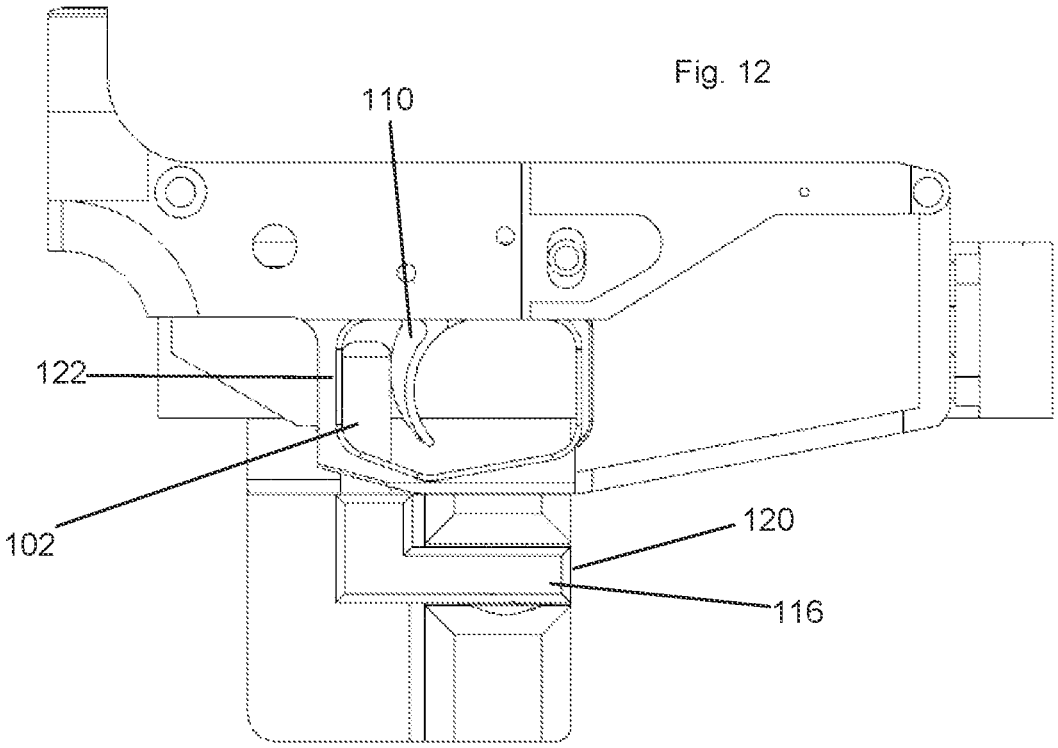
FIG. 12 is a side isometric view of the embodiment of FIG. 10 with the bolt and lever in the closed position.
Figure 13:
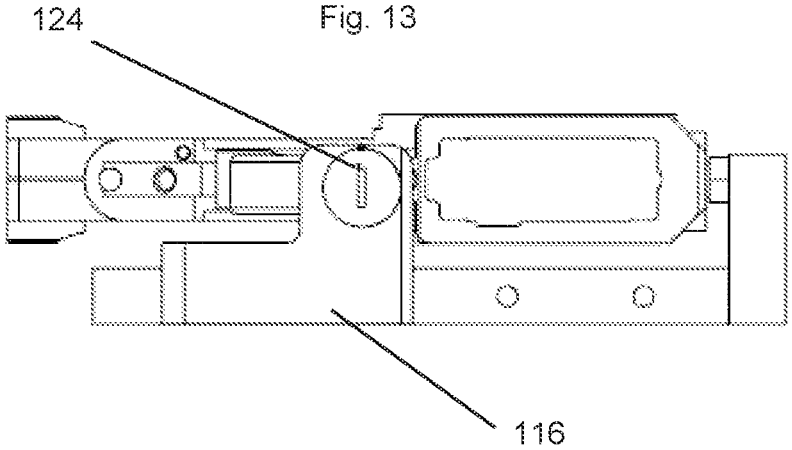
FIG. 13 is a bottom view of the embodiment of FIG. 10 with the bolt and lever in the closed position.
Figure 13:
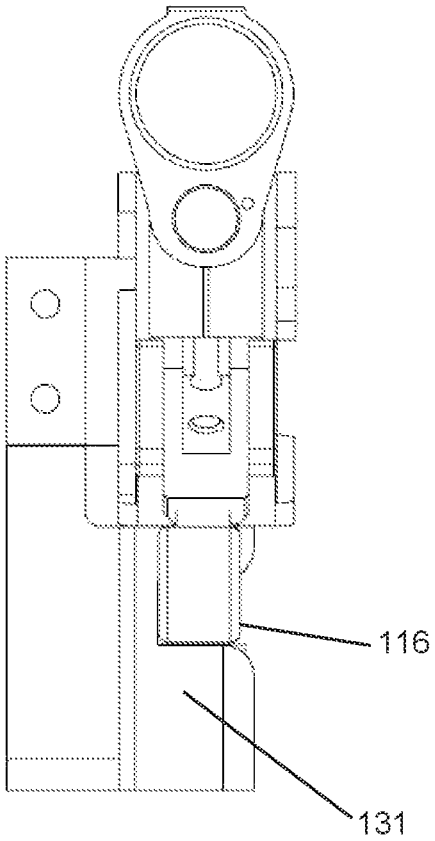

FIG. 12 illustrates the post 102 positioned in the space between the rear 122 of the trigger guard and the trigger 110. FIG. 12 is considered the locked or closed position. FIG. 13 illustrates a bottom view of the mount and lower of the firearm of FIG. 12 in the locked position. Preferably a mechanical lock mechanism such as a keyed lock 124 is positioned on an underside of the lever 116. The lock provides engagement with corresponding structure of the rack to serve to lock the bolt in place and prevent removal of the trigger lock outpost from the space behind the trigger. Preferably, the lever 116 is positioned in a space 120 formed in the body of a mount. FIG. 13.1 illustrates a side view from the left of FIG. 12. The lever 116 is shown positioned in the spacer void of the body 131 of the rack.

Figure 14:
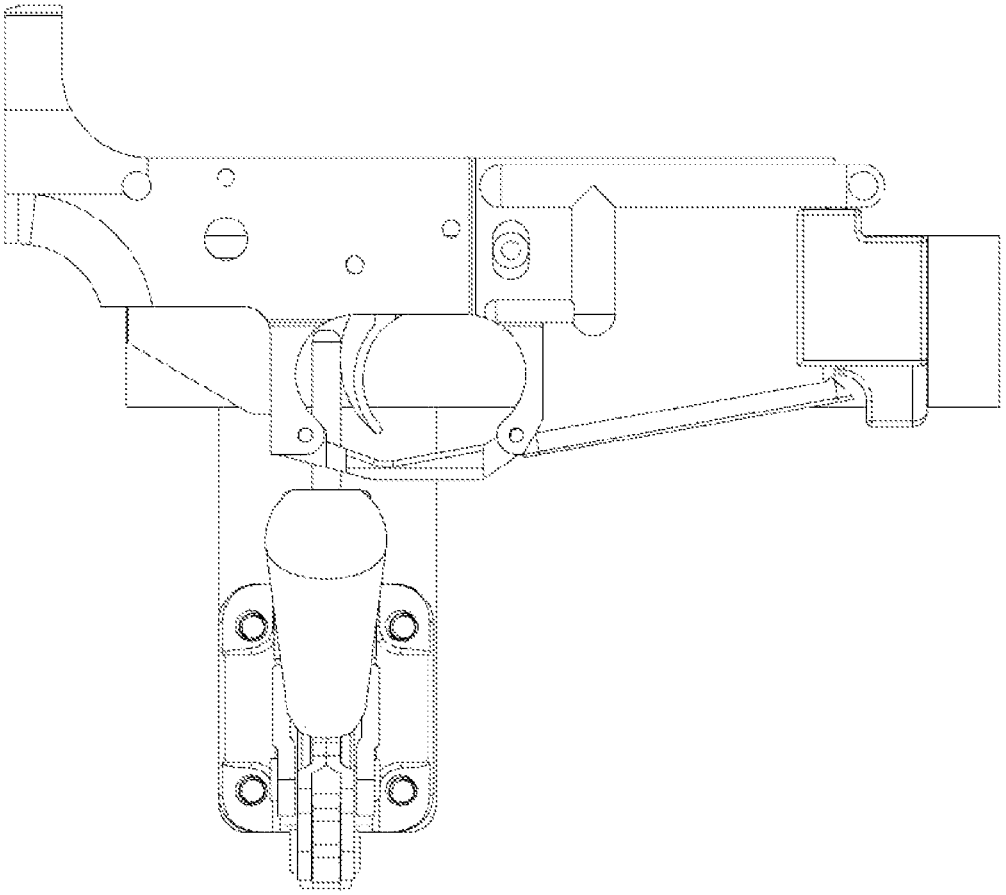
FIG. 14 is an alternate embodiment of a front mount of a gun rack passively supporting a lower receiver being a common cast AR-15 lower receiver.

FIG. 14 illustrates the concept of custom molded front attachment point being the connection in a passive fashion similar in function to reference no. 62. The lower receiver in this example shows the most common cast outside shape AR-15 lower receiver. The lower receiver can be positioned in the adapter shown in FIGS. 15 and 16 that is positioned in a front mount having two posts extending therefrom. Alternative the two posts can be positioned extending from the front mount, with two openings positioned within the adapter.

Figure 15:
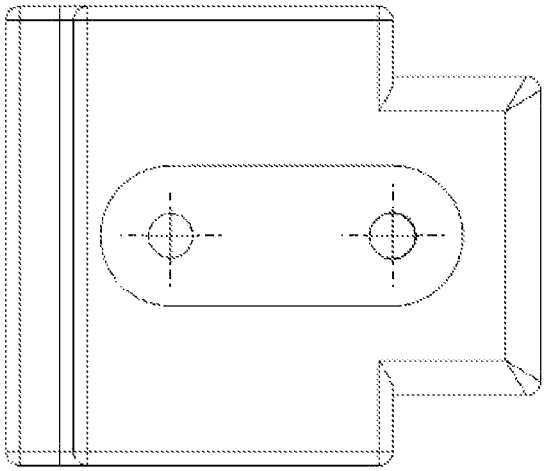
FIG. 15 is a view of an embodiment of a front support mount illustrating the spacing of a two prong front support.
Figure 16:
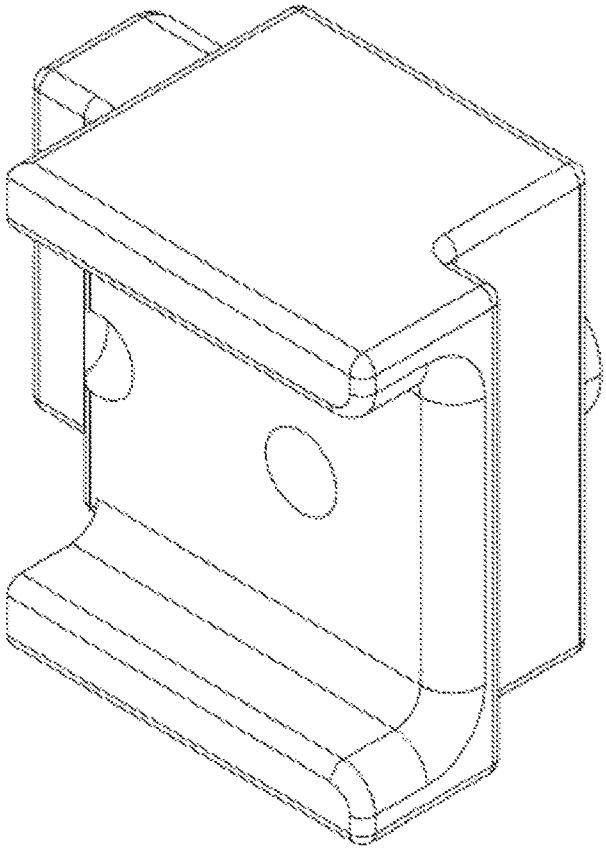
FIG. 16 is a perspective view of a front support mount adapter having a cup support function for supporting the cast front of the lower receiver illustrated in FIG. 14.

FIG. 15 illustrates a preferred spacing mechanism utilized for spacing of two openings configured for posts utilized in the front retaining mechanism. In particular, this spacing is disclosed in the Applicant's co-pending U.S. patent application Ser. No. 17/523,733. The spacing as show is configured for attachment to two prongs extending from a rack. FIG. 16 illustrates the adapter providing a cup for positioning the front of the lower receiver.

Figure 17:
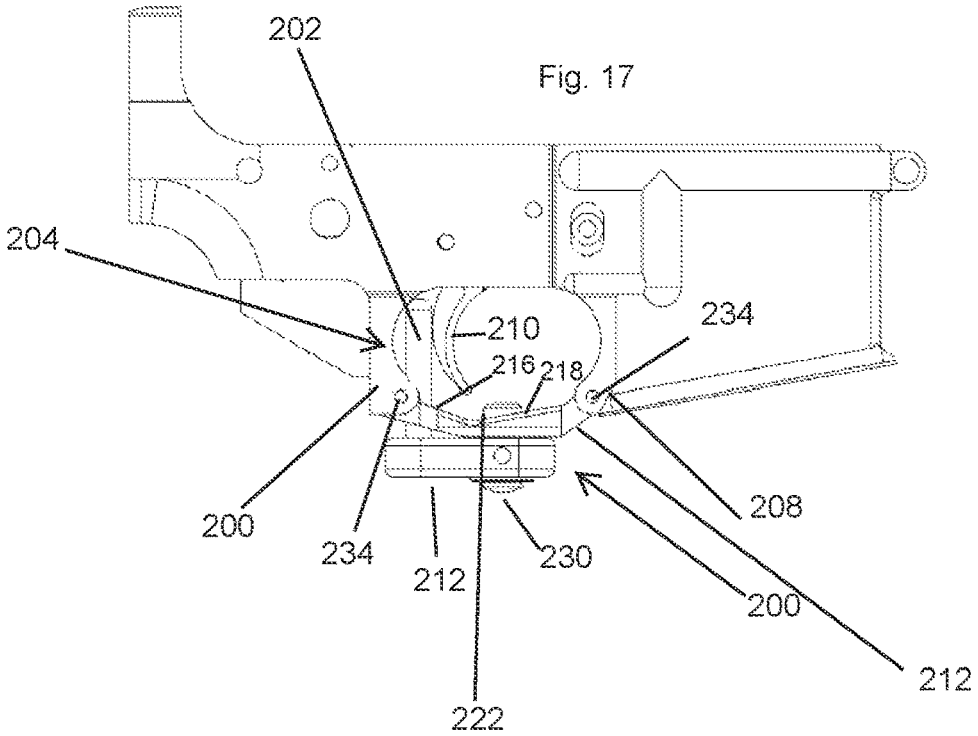
FIG. 17 is an isometric view of a safety device attached to a firearm lower receiver and utilizing a bolt positioned behind the trigger of a lower receiver of a firearm.
Figure 18:
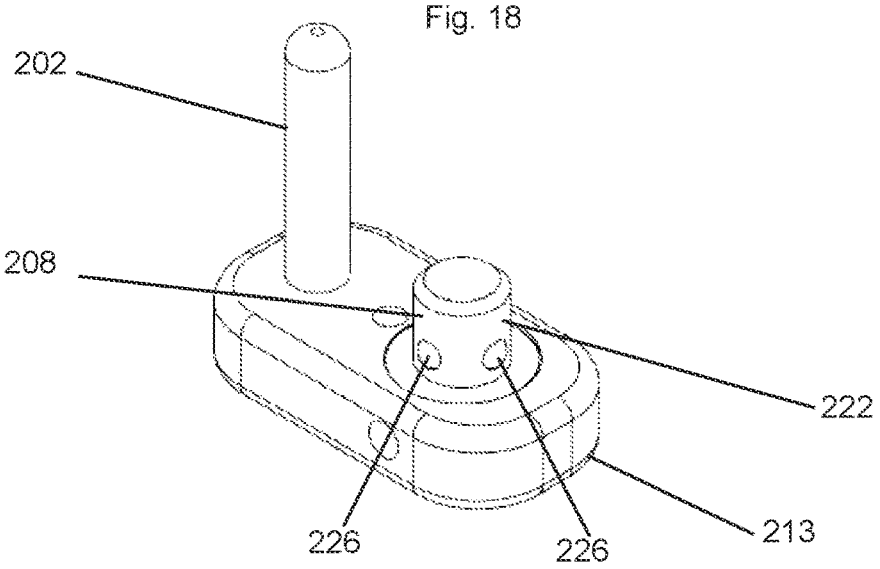
FIG. 18 is a perspective view of the safety device of FIG. 18.
Figure 19:
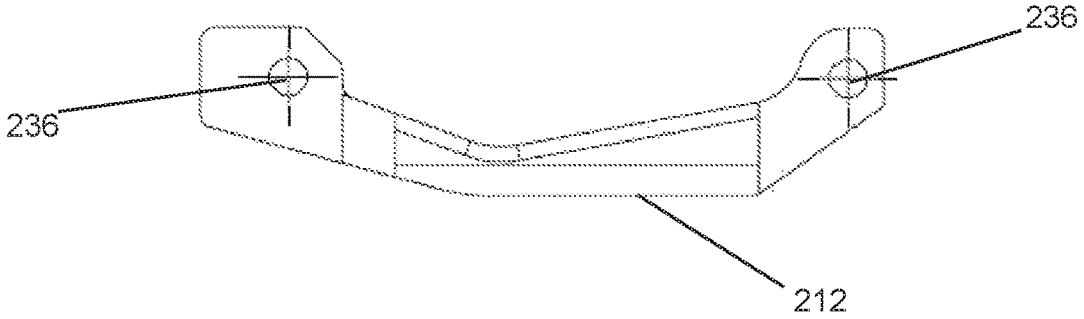
FIG. 19 is an isometric view of a removable lower receiver trigger guard.

FIG. 17 illustrates an embodiment of the invention illustrating a removable locking system for use with the lower of a firearm. FIG. 17 illustrates the safety device 200 having bolts 202 positioned in the space 204 between the rear 206 of the trigger guard 208 of a lower of a firearm. The bolt prohibits the trigger 210 from depressing toward the rear of the trigger guard 206. The depicted embodiment utilizes a trigger guard adapter 212 used in lieu of a standard trigger guard without an opening configured for the bolt 202. The safety device has a body 213 from which the bolt 202 extends upward from. The lower has two openings 216, 218. The safety bolt is extended through the first opening 216 a second opening is provided for the attachment mechanism for attaching the safety device to the trigger guard. The safety device has a post 222 that extends upward from the body 213. The retention post 222 has a series of ball bearings 226 that extend outward from the circumference 228 of the post. The underside of the body has a button or other actuator 230. The actuator can be mechanical or electromechanical, including a locking actuator such as a biometric recognition device. In the depicted embodiment, the button is depressed, releasing spring tension retaining the ball bearings in an outward biased position. Depression of the button allows the ball bearings to be moved in and out of a circumferential channel (not shown) positioned in the lower portion of the trigger guard 212. In the depicted embodiment the replaceable trigger guard is attached via pins 234 in openings 236.

Figure 20:
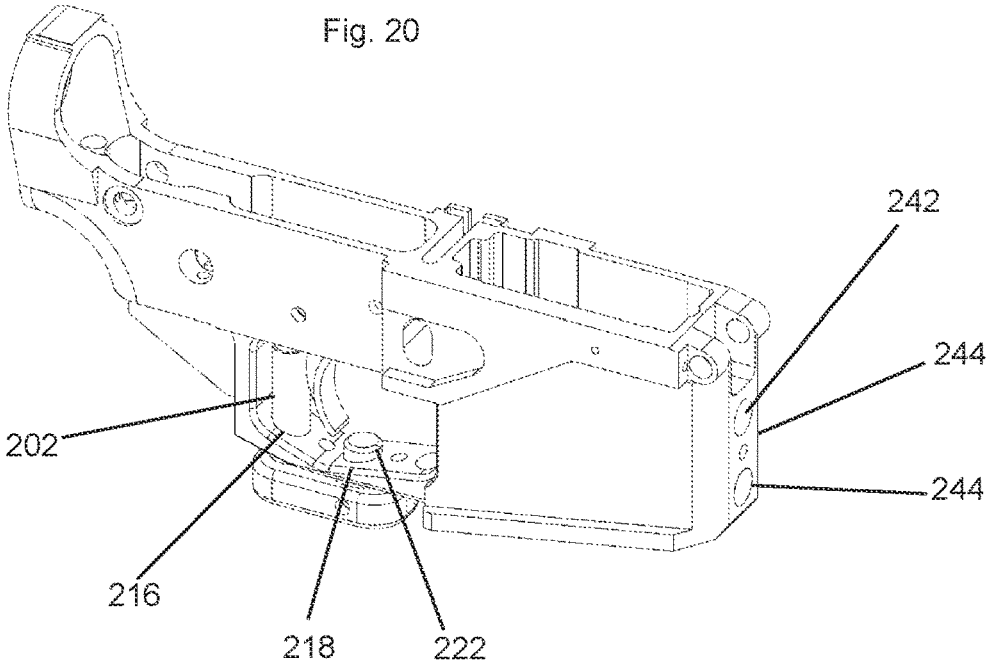
FIG. 20 is a perspective view of a lower receiver having an integral trigger guard with the safety device of FIG. 17 attached thereto and a front configured for mounting on the front mount of the rack.
Figure 21:
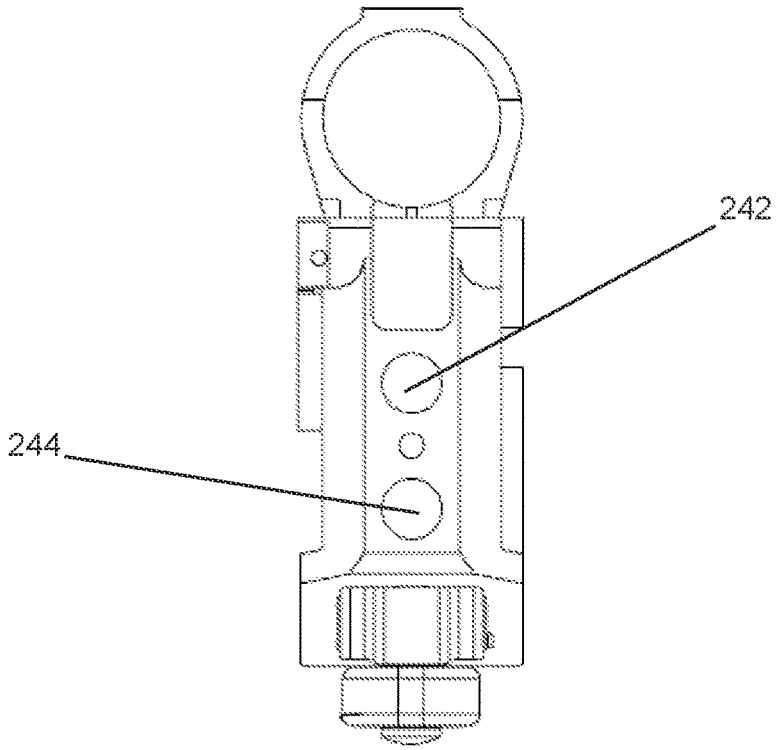
FIG. 21 is a front view of the lower receiver and safety device.
Figure 21:
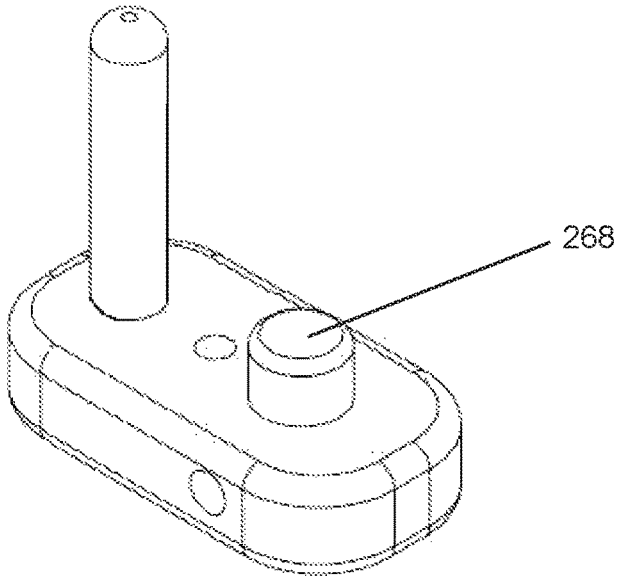
Figure 22:
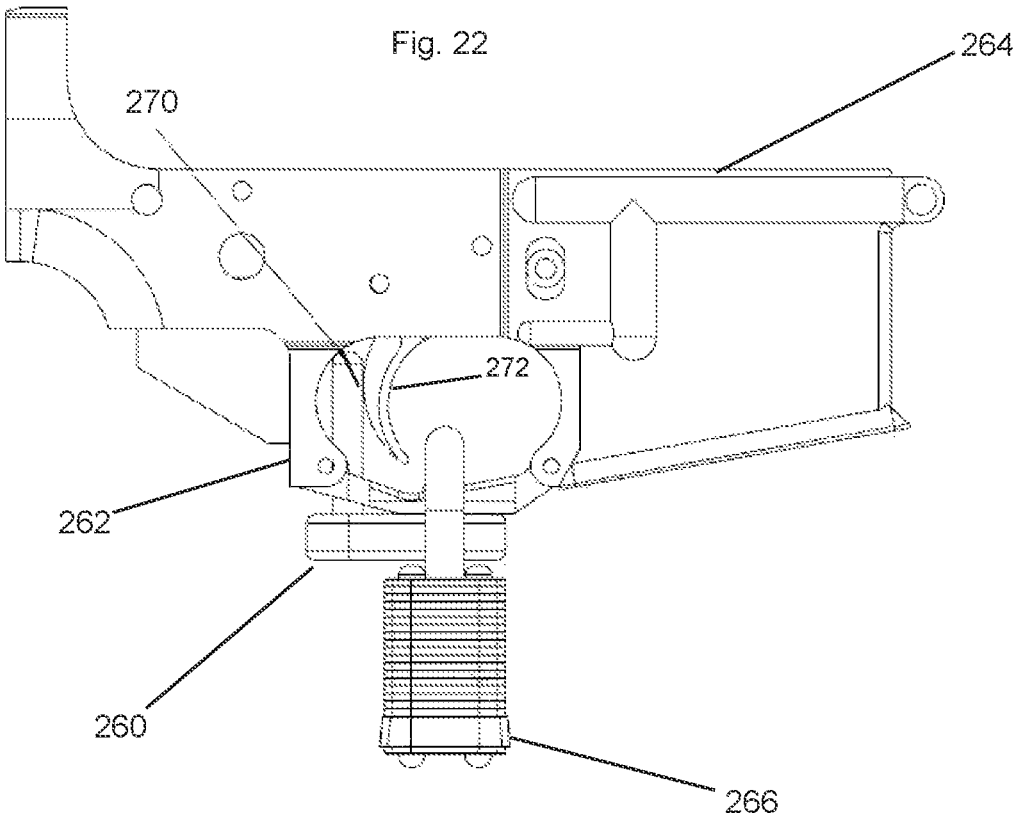
FIG. 22 is an isometric view of a lower receiver with an embodiment of a safety device with a padlock attached.

FIGS. 20-22 illustrate further views attached to a lower. The safety module in FIG. 20 is illustrated with a post 202 extending upward through an opening through the opening 216 in the lower rear of the trigger guard. The retention post 222 is illustrated in a forward opening 218 in the trigger guard. The depicted lower has a forward component 240 that is configured for attachment to a duel post system. The two posts can be passive or active and engage in the openings 242, 244. This can used for example with the DQD system of patent application Ser. No. 17/523,733 or with passive posts for mounting systems such as those shown in the embodiment in FIG. 1. FIG. 22 illustrates an alternate embodiment of the safety device with a padlock utilized for locking the safety device. The padlock retains the safety device to the lower. In the depicted embodiment, a secondary replacement portion of the trigger guard is provided. The lower can be manufactured with this specific device or alternatively as an after-market substitution, such as depicted. In the depicted embodiment the safety post 270 is extending behind the trigger 272 of the lower unit. FIG. 22.1 illustrates the safety device of FIGS. 20-22 showing the post having a through opening that the shackle of the lock 266 of FIG. 22 is positioned through to lock the retaining device to the lower.

Figure 23:
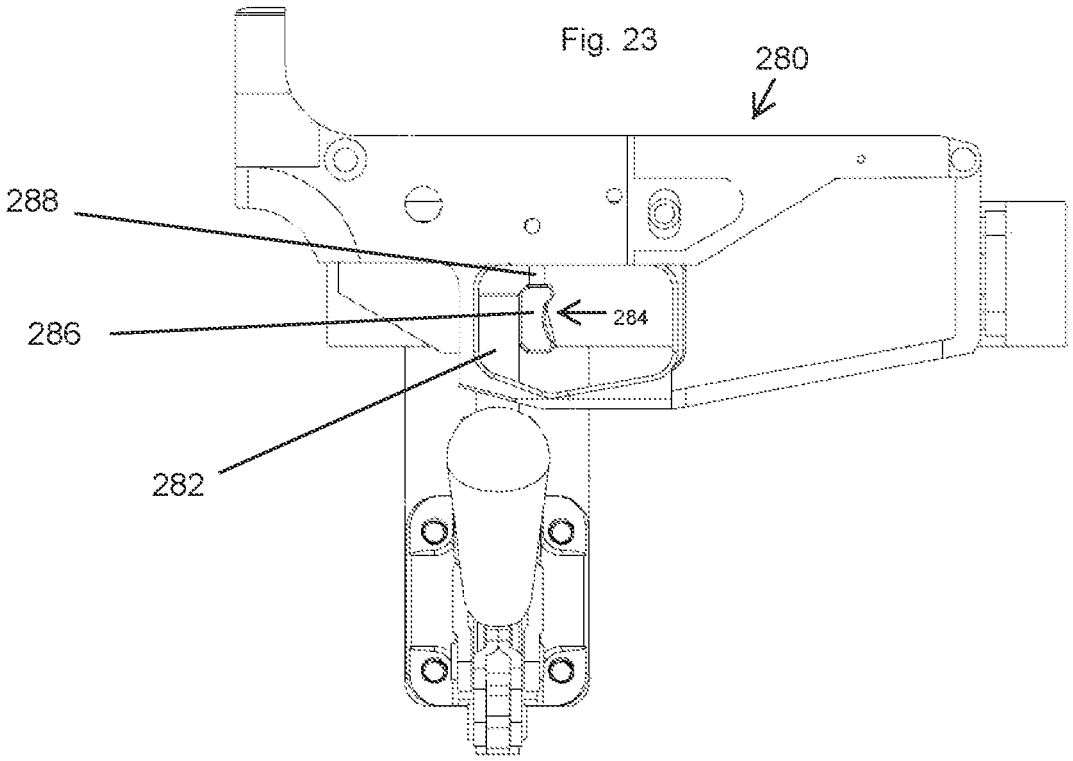
FIG. 23 is an isometric view of a safety device incorporated into a rack supporting a lower having a breakable trigger assembly.
Figure 24:
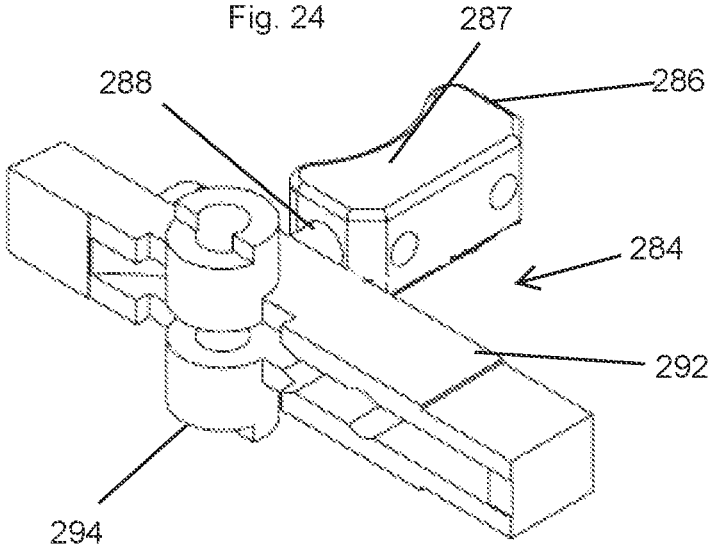
FIG. 24 is a perspective view of a breakable trigger assembly.
Figure 25:
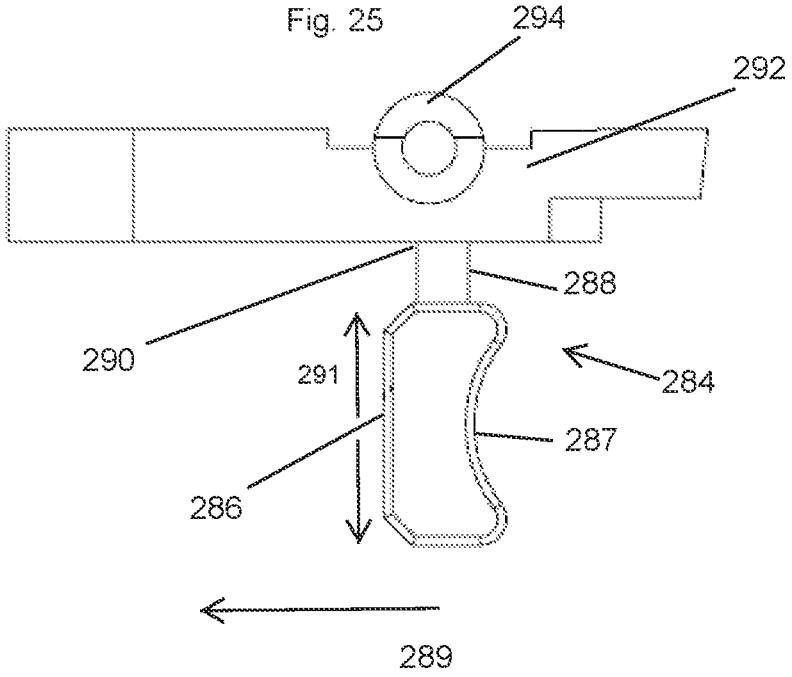
FIG. 25 is an isometric view of a breakable trigger assembly.

FIGS. 23-25 illustrate a further safety mechanism that can be utilized with a mount and lower. In the depicted embodiment of FIG. 23, an improved trigger assembly 284 is provided in the lower receiver 280. The replacement trigger is configured to be compatible with a variety of lowers such as those in an AR-10/AR-15 style lower receiver. The replaceable trigger has a shaft 288 constructed of a breakable or brittle material extending from the trigger body 292. The brittle material is configured to withstand the depression force on the finger depression 287 of the trigger shoe 286 when the firearm is free of a safety device and/or mounting rack having a bolt in the depression space. However, when the firearm is attached to a safety device or rack having an integral safety device such as the embodiments described above, attempts to forcefully remove the firearm cause the trigger to be forcefully moved around the bolt 282, causing the trigger post to break. The post 288 of the trigger assembly is configured to break at the connection point 290 of the trigger post 288 to the trigger body 292. In the depicted embodiment the trigger assembly has a cylindrical actuator 294 that is connected to the action, often by springs, to actuate firing of the device. Depression of the trigger shoe 288 rearward 289 causes rotation of the cylindrical actuator 294, thus causing actuation of the firing mechanism of the action. Alternate firing actuators may be utilized with the trigger assembly. The trigger extends away from the lower receiver and defines an axis 291 generally perpendicular to the longitudinal axis of the firearm (depicted as 19 in FIG. 1). The trigger is operated by depressing the trigger by applying a force 289 to the trigger to move the trigger rearward. The bolt 270 interferes with depression of the trigger when a force having a rearward vector 289 is applied to the finger depression 287 of the trigger.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A firearm safety rack for use with a firearm, the firearm having a receiver having an action comprising a firing mechanism configured for firing a projectile through a barrel attached to the receiver, the action and barrel defining a longitudinal axis of the firearm, and a trigger configured to actuate the firing mechanism, the trigger extending from the action and defining a trigger longitudinal axis generally perpendicular to the longitudinal firearm axis, wherein application of a force to said trigger generally parallel to said firearm longitudinal axis actuates the action of the firearm, the receiver further comprising a trigger guard positioned beneath said trigger and extending generally parallel to the depression force required to depress the trigger, wherein the safety rack comprising:

a receiver support, said receiver support comprising a receiver support body configured for supporting a receiver of a long firearm, said receiver support body comprising a bolt extending from said receiver support body and defining a bolt longitudinal axis, wherein said bolt is configured for positioning through an opening in the trigger guard of the firearm, wherein the opening is positioned opposite the action of the firearm and said bolt extending vertically through said trigger guard generally perpendicular to a direction of pull of said trigger and generally parallel to the trigger longitudinal axis, said bolt configured to extend through the opening of the trigger guard into a depression space behind said trigger to prevent depression of said trigger;

a pin extending from said body in a direction generally perpendicular to said bolt, wherein said pin is configured for insertion into a grip of a lower receiver to prevent rotation and/or lifting of the firearm when the firearm is positioned on the rack; and a front support, wherein said front support is configured to support the firearm at a position on the firearm toward the end of the barrel of the firearm.

2. The firearm safety rack of claim 1, wherein said body comprises an actuator configured to move said bolt from a closed position in which said bolt is in the depression space to an open position which said bolt is removed from the opening in the trigger guard.

3. The firearm safety rack of claim 2, wherein said actuator comprises a lever, wherein said lever is configured to actuate insertion said bolt into and out of the opening in the trigger guard.

4. The firearm safety rack of claim 1, wherein said front support comprises a post configured for insertion into an opening in the front of the receiver of the firearm.

5. The firearm safety rack of claim 4, wherein said post comprises an active retention mechanism.

6. The firearm safety rack of claim 5, wherein said active retention mechanism comprises a series of ball bearings positioned in a circumference of said post, wherein said ball bearings are biased outward from said circumference, wherein said retention mechanism comprises a actuator configured to release the biasing on said ball bearings.

7. The firearm safety rack of claim 6, wherein said actuator comprises a button.

8. The firearm safety rack of claim 3 wherein said lever comprises a paddle configured to cover the trigger of the firearm when said lever is in a closed position.

9. The firearm safety rack of claim 3 further comprising a lock configured to lock said lever in said closed position.

10. The firearm safety rack of claim 3 wherein said lever is configured to slide upward to position said bolt in the depression space behind the trigger and to rotate the lever to a locking position.

11. The firearm safety rack of claim 1, wherein said receiver support and said front support are connected by a rack support body, wherein said rack support body is configured for attachment to a substrate.

12. The firearm safety rack of claim 4, wherein said front support comprises a shelf adapter configured for engagement with said post of said front support, wherein said shelf adapter is configured with a shelf to support the front of a firearm.

13. The firearm safety rack of claim 4, wherein said front support comprises a shelf configured to support the front of the firearm.

14. A firearm safety rack and compatible lower receiver for a firearm, wherein: said firearm safety rack comprising a receiver support, said receiver support comprising a body configured for supporting a receiver of a long firearm, said body comprising a bolt extending along a bolt longitudinal axis, wherein said bolt is configured for positioning through an opening in a trigger guard of a firearm, wherein the opening is positioned opposite the action of the firearm and said bolt extending vertically through said trigger guard generally perpendicular to a direction of pull of a trigger and parallel to a longitudinal axis of the trigger, said bolt configured to extend through the opening of the trigger guard into a depression space behind said trigger to prevent depression of said trigger; and a front support, wherein said front support is configured to support the firearm at a position on the firearm toward the end of the barrel of the firearm; and a pin extending from said body in a direction generally perpendicular to said bolt, wherein said pin is configured for insertion into a grip of the lower receiver to prevent rotation and/or lifting of the firearm when the firearm is positioned on the rack;

wherein said lower receiver comprising the trigger extending generally perpendicular to a longitudinal barrel axis and the trigger configured for depression toward a rear of said lower receiver, wherein said lower receiver and said trigger defining the depression space behind said trigger into which said trigger is depressed to actuate firing of the firearm to which said lower receiver is attached;

the trigger guard positioned beneath said trigger and comprising said opening of the trigger guard and the trigger guard opening is configured for insertion of said bolt through said trigger guard toward said lower receiver and parallel to the longitudinal axis of said trigger so as to prohibit depression of said trigger.

15. The firearm safety rack of claim 14, wherein said trigger comprises a trigger shaft configured to break if said trigger is positioned in said rack and a lateral force is applied to said trigger to remove said trigger from said rack.

16. The firearm safety rack of claim 14, wherein said body comprises an actuator configured to move said bolt from a closed position in which said bolt is in the depression space to an open position in which said bolt is removed from the opening in the trigger guard.

17. The firearm safety rack of claim 15, wherein said actuator comprises a lever, wherein said lever is configured to actuate insertion of said bolt into and out of the opening in the trigger guard.

* * * * *